US008181780B1

(12) United States Patent
Guffey et al.

(10) Patent No.: US 8,181,780 B1
(45) Date of Patent: May 22, 2012

(54) SOCKET STORAGE DEVICE

(76) Inventors: William Tracey Guffey, Shelbyville, TN (US); Troy Beavers Yoes, Shelbyville, TN (US)

( * ) Notice: Subject to any disclaimer, the term of this patent is extended or adjusted under 35 U.S.C. 154(b) by 0 days.

(21) Appl. No.: 13/230,925

(22) Filed: Sep. 13, 2011

Related U.S. Application Data

(63) Continuation-in-part of application No. 12/792,302, filed on Jun. 2, 2010, now abandoned.

(60) Provisional application No. 61/186,021, filed on Jun. 11, 2009.

(51) Int. Cl.
*B65D 85/28* (2006.01)

(52) U.S. Cl. ..... 206/378; 206/493

(58) Field of Classification Search ..... 206/378, 206/376, 372, 373, 493
See application file for complete search history.

(56) References Cited

U.S. PATENT DOCUMENTS 4,421,230 A * 12/1983 Stanton ..... 206/378
6,070,745 A * 6/2000 Dembicks ..... 211/70.6
2006/0254940 A1* 11/2006 Mu et al. ..... 206/378

* cited by examiner

*Primary Examiner* — Jacob K Ackun
(74) *Attorney, Agent, or Firm* — Stephen J. Stark; Miller & Martin PLLC

(57) ABSTRACT

A socket holding device has a plurality of posts extending from a base. The base may be arranged so that shallow wells are linearly arranged in front of deeper wells with the posts extending from the center of the wells. The posts have arms with a radial bead connected thereto receivable within receivers in the shafts of sockets. A socket may be securely retained to the base thereby preventing undesired disengagement from the well if inverted or "knocked over", while preferably allowing free rotation of an installed socket thus enabling one to read the sizing information on the exterior surface of the socket. This design is believed to provide an ability to be installed and uninstalled from the post multiple times without a loss of grip function and also preferably requires no secondary motion to remove or release the socket, and can consist of a one-piece design.

20 Claims, 4 Drawing Sheets

SOCKET STORAGE DEVICE

CLAIM OF PRIORITY

This application is a continuation in part application of U.S. patent application Ser. No. 12/792,302 filed Jun. 2, 2010 now abandoned, which, in turn, claims the benefit of U.S. Provisional Patent Application No. 61/186,021 filed Jun. 11, 2009.

FIELD OF THE INVENTION

The present invention relates to a socket storage device in the form of a holder fixture which {1} after the socket is installed allows socket rotation, {2} is held preferably with a sufficient force that the socket cannot detach by itself when the fixture is inverted or "knocked over", {3} allows the socket to be installed and uninstalled multiple times without losing the function of grip, {4} requires no secondary motion to remove or release the socket apart from pulling the socket off the holder, {5} consists primarily of a one-piece or integrally molded design and preferably such a device configured to accommodate a plurality of various sizes and shapes of sockets and/or accessories that can be used to install and/or extract bolts, nuts or screws.

BACKGROUND OF THE INVENTION

The applicant is aware of socket holding devices which provide a plurality of wells into which a socket can be placed. However, most of these prior art devices provide wells which receive sockets. However, when the socket holder is turned upside down, the sockets would normally then fall out of the wells.

Some prior art designs provide a round pin in the center of the well which does not grab a socket but instead guides the socket into the well. When these designs are inverted, the sockets fall out. Others provide a square pin in the center of the well which does not grab a socket but instead guides the socket into the well. When these designs are inverted, the sockets fall out. Furthermore, these square pin designs require the user to orient the sockets 1 in a desired position when installing as the sockets 1 cannot be turned after installing if one desires to read the sizing information on the exterior surface of the sockets because the socket shaft 14 is square and usually of similar perimeter dimensions as the pin thereby preventing rotation.

Some prior art designs incorporates a round or square post that uses an interference fit with the side walls of the socket shaft 14 and are primarily used in the packaging and security of the socket in the retail store. These designs are typically broken when the socket is removed. {1} Rotation of the round post designs might be achieved but it is difficult due to the force of the interference fit. Other such round post design {such as Dembicks, U.S. Pat. No. 5,715,951 is believed to provide} relies on a cam action to provide the interference fit necessary to hold the socket with the side walls of the socket shaft 30 and not the socket grooves 2 but this design limits the rotation of the socket in the lock position {4} and a secondary motion for the cam other than pulling the socket from the post must be imputed by the user to lock the socket in place. Square post designs {such as Stanton, U.S. Pat. No. 4,421,230} do not allow of such rotation because the socket shaft 14 is square. {3} Also these post designs are not believed to work well because when the socket is removed from the post, the post either breaks the hiding features and with each attach and detach of the socket causes a reduction in its interference function until such point the post cannot retain the socket.

Some prior art designs {such as Stanton, U.S. Pat. No. 4,421,230} incorporates a round or square post that grips (by use of a snap-fit design) the socket by the back face 200 of the socket. Again these designs are believed to be primarily used in the packaging and security of the socket in the retail store and are typically not used again once the socket is removed. {1} Rotation of the socket can be achieved with the round post but not with the square post designs because the socket shaft 14 is square. {3} These designs are not believed to work satisfactorily because when the socket is removed from the post, the post breaks the holding features. The normal way to remove the socket from the holding feature is to use a tool (screwdriver or pliers) to pry the holding feature away from the back face of the socket. Also, this design is believed to be limited to socket sizes that have a socket head-nut or bolt size 201 that is smaller than the effective diameter of the socket shaft 14. In this case, a different size or design of the post is necessary.

Another prior art design {as disclosed in Mu, U.S. Patent Application No. U.S. 2006/0254940} incorporates a square post that grips the socket by the socket grooves 2. The periphery grooves 2 located in the socket shaft 14 are used to hold the socket on to the ratchet or extension to install and/or extract bolts, nuts or screws. {1} Again, rotation of the socket cannot be achieved because the socket shaft 14 and post are square and of similar dimensions. {5} also the design is considered a two piece design with the socket retaining feature as one piece and the base or tray to which the socket will rest being the secondary piece. This design would be a concern for manufacturing and assembly costs because of the two-piece design.

One improvement over this construction as is available on the market includes magnetic socket holders which have magnets along the sides or bottom of the wells. However, once the socket is placed into a well having a magnet, the socket still cannot be easily turned to view the information normally provided on the exterior surface of a socket such as its size and if the holder is inverted or "knocked over"/vibrated and the magnets are not believed to be strong enough to overcome the weight of the biggest sockets, the socket can "fall out". {5} Also the design is considered by the applicant to be a two piece design with the socket retaining feature (magnet) as one piece and the base or tray to which the socket rests being the secondary piece. This design too would be a concern for manufacturing and assembly costs because of the two-piece design.

Accordingly, there is believed to be a need for improvement over prior art socket holding devices. A design that can simultaneously carry out at least some, if not all of, the functions of {1} an installed socket is allowed to freely rotate to see the sizing information on the exterior surface of the socket, {2} is held with such a sufficient force that the socket cannot detach by itself when the fixture is inverted or "knocked over/vibrated", {3} allowed to be installed and uninstalled multiple times without losing the function of grip, {4} requires no secondary motion apart from pulling the socket of the holding device to remove or release the socket, and {5} consists of a one-piece design to reduce manufacturing and assembly costs.

SUMMARY OF THE INVENTION

It is a present object of at least some embodiments of the present invention to provide an improved socket holding device.

It is another object of at least some embodiments of the present invention to provide a socket holding device having a plurality of wells with each configured to have a post therein configured to retain an inserted socket.

It is another object of at least some embodiments of the present invention to provide a plurality of posts internal to wells in the socket holding device wherein the posts are resiliently biased to retain inserted sockets through engagement with the socket groove.

It is still another object of the present invention to provide a socket holding device wherein the socket holding device can be inverted or "knocked over"/vibrated and still retain properly installed sockets.

It is yet another object of at least some embodiments of the present invention to provide a socket holding device wherein although the sockets are retained in various wells, the sockets can be relatively easily rotated such as for convenience in being able to read sizing information as is normally printed on exterior surfaces of the socket.

It is yet another object of at least some embodiments of the present invention to provide a socket holding device wherein the sockets can be installed and uninstalled multiple times and still provide an adequate gripping function through normal use.

It is yet another object of at least some embodiments of the present invention to provide a socket holding device that can be manufactured as a one-piece design.

Accordingly, in accordance with at least one presently preferred embodiment of the present invention, a socket holding device provides a plurality of posts such as extending the common direction from a base as can be arranged in trays in wells. The posts can extend one or more arms and with each arms a comprising of a bead so that when a shaft of a socket is placed thereon the beads deflect inwardly into the shaft until reaching a socket groove and then the arms and/or beads deflect outwardly into the socket groove thereby retaining the socket securely on the post while still allowing the rotation of the socket so a user could potentially read the sizing information normally printed on the exterior of the socket. Furthermore, the device can be inverted or "knocked over"/vibrated without the socket falling off the post. Although all advantages may not be experienced by all embodiments, these advantages and others relate to the embodied by the present embodiment.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 5:
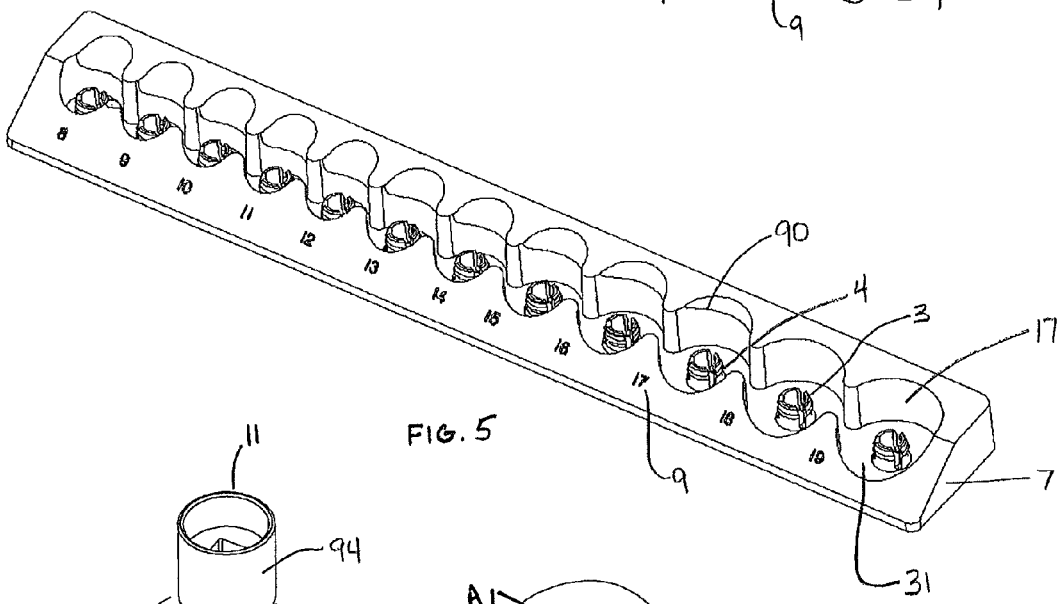
FIG. 5 is a top perspective view of the portion of the storage device shown in FIG. 5.
Figure 6:
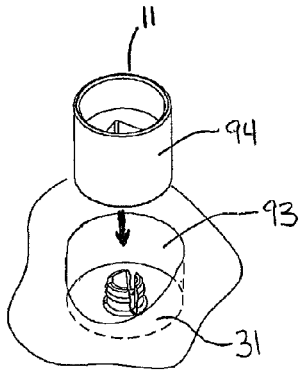
FIG. 6 is an exploded view showing the insertion of a socket into one of the wells of the embodiment of FIGS. 5 and 6.
Figure 7:
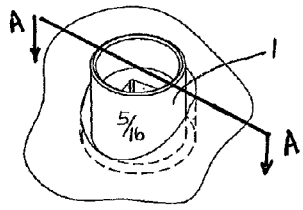
FIG. 7 is a detailed view of the structure of FIG. 7 with the socket installed and internal portions shown in phantom.
Figure 9:
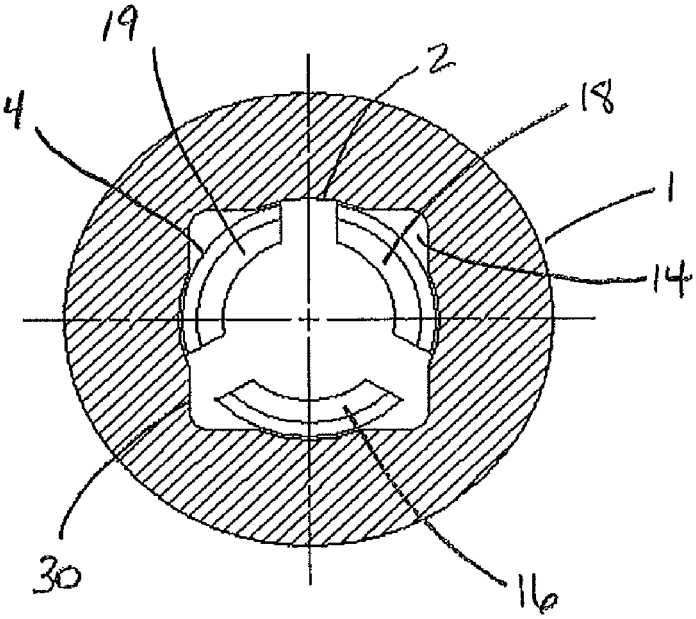
FIG. 9 is a cross sectional view taken along the line B-B of FIG. 8 of the present invention.

FIG. 5 together with FIG. 6 shows a presently preferred embodiment of the present invention in the form of a socket holding device 100 which is comprised of first and second trays 7 and 8. First row of tray 7 is shown without the sockets connected thereto in FIG. 6 while FIG. 5 shows sockets of various sizes occupying the various positions as will be described in further detail below.

Figure 1A:
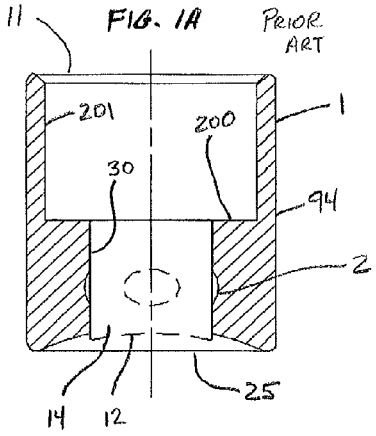
FIG. 1A PRIOR ART
FIG. 1A is a cross sectional view of a socket as taken along the center line.
Figure 1B:
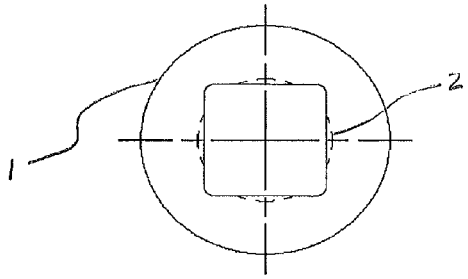
FIG. 1B is a bottom perspective view of internal parts shown in phantom of the socket shown in FIG. 1A.

Sockets 1 are well known in the art. Sockets 1 are utilized to extract bolts, nuts or screws as well as inject or install bolts, nuts or screws as are known in the art. Sockets 1 have a first female end 11 which receives the top of a bolt or nut and even some screws. Sockets, also normally have a second female end 12 which is normally utilized to receive an extension from a ratchet, nut driver or other structure. The square ratchet or nut driver would often have a detent ball which is received in at least one of the four socket grooves 2 in the socket 1. In other embodiments, instead of having multiple socket grooves 2, a single socket groove 2 extending a radial distance beyond and about the square shaft 14 as is known in the art. These grooves 2 in the socket 1 are typically radial in nature and have a specific diameter to determine the depth of the groove 2 in all four shaft walls 30. FIGS. 1A and 1B show a typical socket in the prior art of socket 1 having socket grooves 2.

Figure 2A:
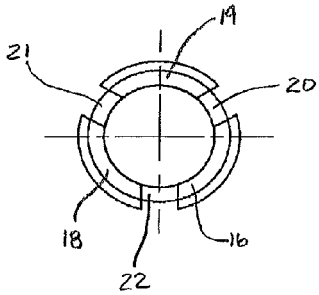
FIG. 2A is a top plan view of a post of the presently preferred embodiment of the present invention.
Figure 2B:
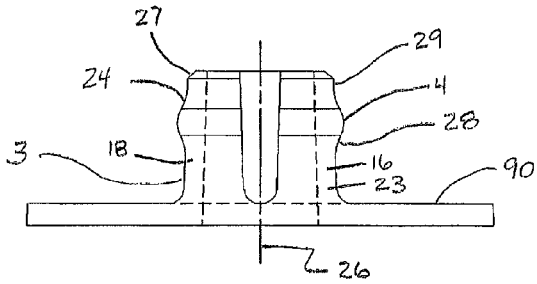
FIG. 2B is a side plan view of a post shown in FIG. 2A.
Figure 3:
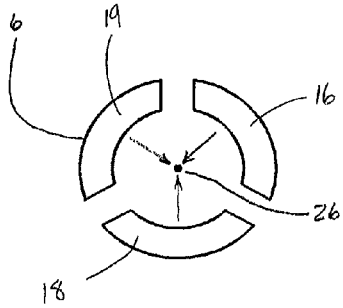
FIG. 3 is a diagrammic representation of the post shown in FIGS. 2A and 2B of the second embodiment.
Figure 4:
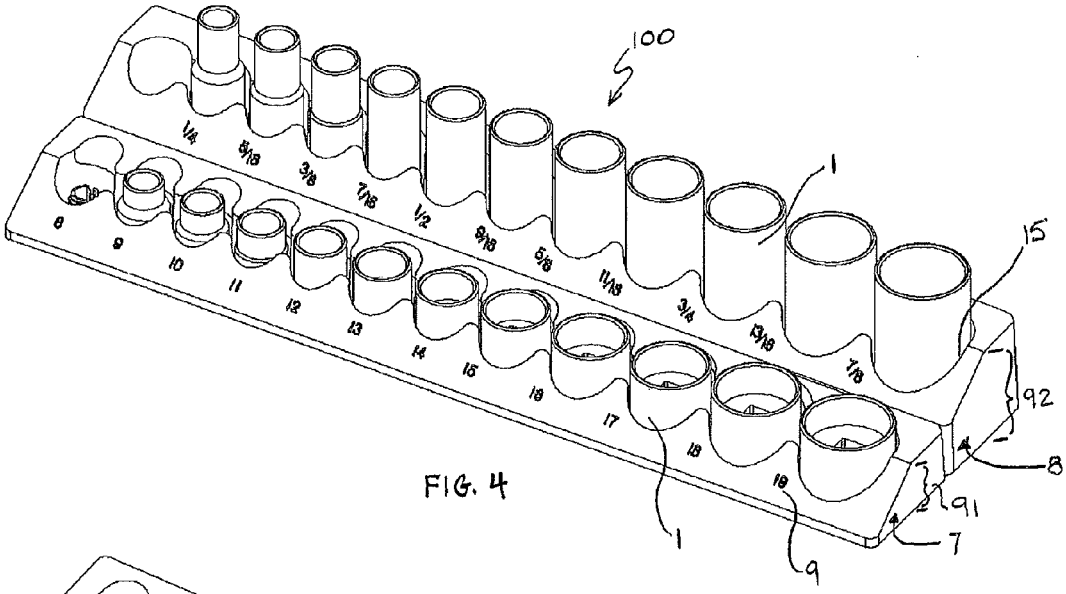
FIG. 4 is a top perspective view of a first embodiment of a presently preferred embodiment of the present invention in the form of a socket storage device.

FIGS. 2A and 2B show detail of a holding feature also known as a post 3 which is preferably provided in a well such as deep well 15 as well as shallow well 17 collectively referred to as wells 15,17. The holding features preferably provide at least one if not a plurality of arms 16 which are connected to one or more beads 4 contained on at least one if not each of the arms 16. Three arms 16,18 and 19 are illustrated, each having bead portions forming beads 4 therein. The arms 16,18,19 preferably are spacedably one or more slots such as slots 20,21,22. Slots 20,21,22 allow for the arms 16,18,19 to deflect towards one another as the shaft bore 14 is directed over the post 3. The arms 16,18,19 may deflect towards one another such as is illustrated in FIG. 4. The beads 4 can then engage into all of the socket grooves 2 as rotated and at least one when stationary. A plurality of arms 16,18,19 can be utilized whether it is three arms 16,18,19 as is shown in FIGS. 2A, 2B. Symmetric or non-symmetric dispositions of arms 16,18,19 about center line 26 may be utilized. Furthermore, bead portions 4 may be deflectable inwardly such as towards center line 26 independently of or together with arms 16,18,19.

In the preferred embodiment, the outer circumference around the body 23 of an arm 16,18,19 preferably defines an outer diameter which cooperates with the shaft 14 (i.e., is slightly or at least sufficiently smaller) whereas the bead 4 preferably has a slightly greater diameter. The diameter about the body 23 of an arm before insertion into shaft 14 is preferably smaller than an internal effective diameter of the shaft 14. The bead 4 also preferably has a rounded and/or angled top edge 24 hereto referred as "beveled" so that when the top edge 24 contacts the bottom surface 25 of the socket 1 and/or sides 30 of shaft 14, the bead 4 is then deflected inwardly toward center line 26 until it passes into and/or through the shaft 14 and the bead 4 can then extend outwardly into the socket grooves 2. Shoulder 29 is also preferably similarly constructed as body 23 and may have an angled or arcuate surfaces 27 so as to facilitate the insertion and/or deflection of the arms 16,18,19 and/or bead 4 as are helpful. Bottom surface 25 of socket 1 can also rest on bottom 31 of base 90 and/or wells 15,17 when installed for at least some embodiments.

Figure 8:
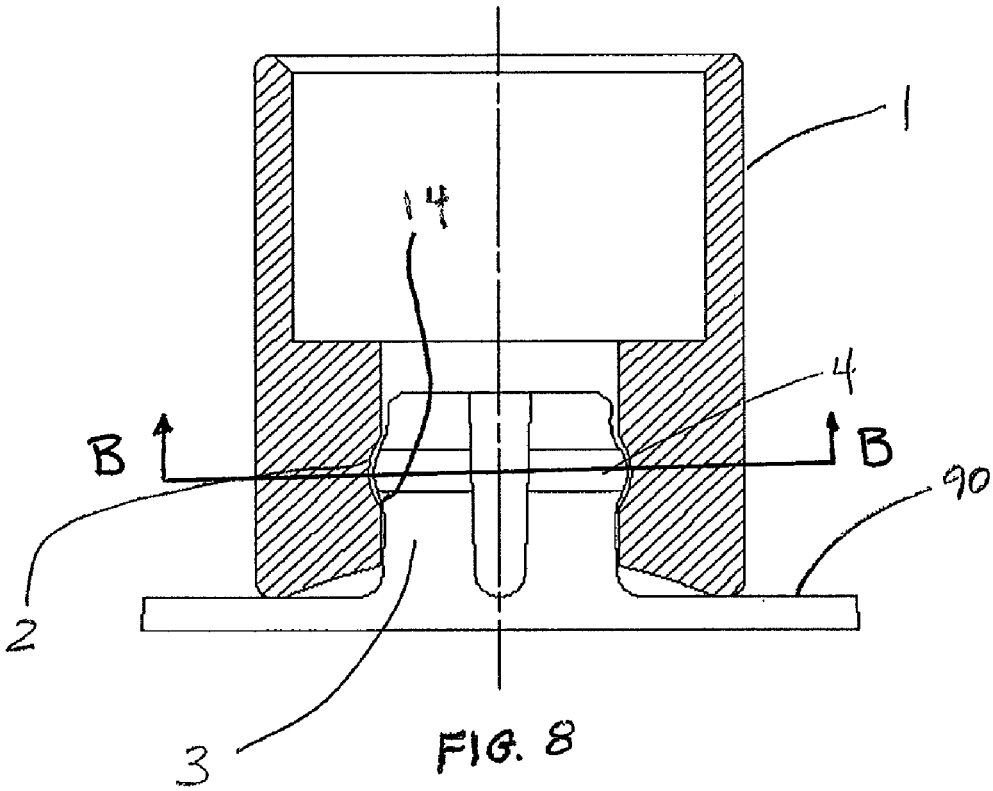
FIG. 8 shows cross sectional view of the present invention taken along the line A-A of FIG. 7.
Figure 10:
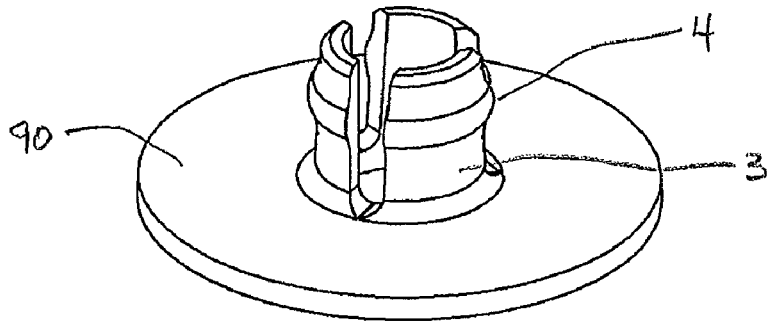
FIG. 10 is an isometric or top perspective view of a presently preferred embodiment of the present invention.
Figure 11:
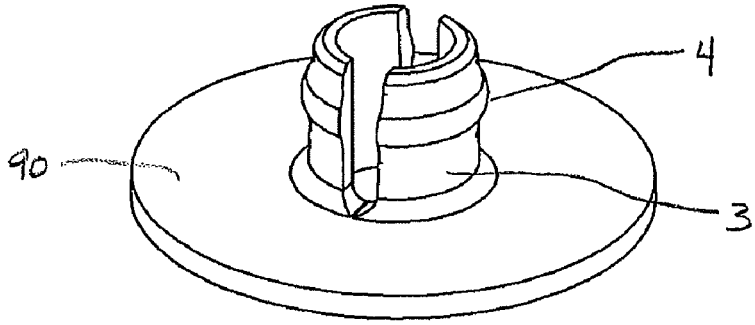
FIG. 11 is an isometric view of a second embodiment of the collecting device in accordance with the present invention.
Figure 12:
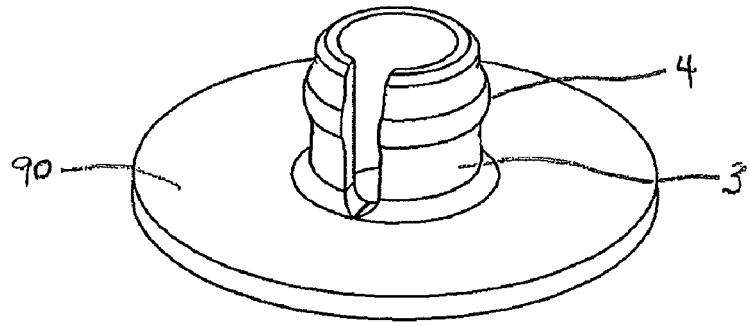
FIG. 12 is an isometric view of a third embodiment of the collecting device in accordance with the present invention.

The arms 16,18,19 expand outward after bead 4 enters the socket groove 2. Bead 4 is thus captured and encapsulated by groove 2 therefore preventing socket 1 from disengagement with arms 16,18,19 when tray 7,8 are moved, turned upside down, or any other various motions. Furthermore, it can be realized from FIG. 10 after socket 1 is installed to post 3 and bead 4 engages groove 2 that socket 1 can normally easily rotate whilst not engaging from the lower surface 29 from grooves 2 of socket 1. As may be seen from FIG. 8, the groove 2 preferably has a larger outer perimeter than the bead 4 so there is preferably not a friction fit. The groove 2 may also cooperate with shaft 14 to provide a perimeter about the bead 4 when installed as shown in FIG. 8 keeping the bead 4 from passing through the shaft 14 unintentionally. The bead 4 whether continuous or discontinuous as shown can possibly engage multiple segments of the groove 2 as shown, and possibly all of them as sown, for at least some embodiments.

The lower surface 28 of the bead 4 preferably may provide an angled and/or curved lower surface 28 (hereinafter "beveled") to facilitate the desired removal of a particular socket 1 such as by pulling so that the curved surface 28 acts against the socket groove 2 or elsewhere (including sides 30 of shaft 14) pushing inwardly until freed as at least some of the arms 16,18,19 are pulled toward one another until they pass through the shaft 14. The socket 1 can preferably be removed from the post 3 once the bead 4 exits the grooves 2 and shaft 14. The perimeter of the shaft 14 is normally configured so that bead(s) 4 are retained in the groove 2 once installed until the socket 1 is pulled off the post 3 by a user.

The posts 3 used with the trays 7 and 8 of the device 100 are preferably provided in parallel arrangement by and/or in a tray 7 or 8 or trays 7,8 in one embodiment. The posts 3 connect to base 90 which could be the trays 7,8 in various embodiments, planar arrangements such as from bottoms 31, and/or other bases 90. Other bases could be provided for various embodiments. One arrangement is shown in FIGS. 5 and 6. Posts 3 may also be installed relative to a bottom 31 of wells 15,17. Although wells 15,17 are shown with 17 being a shallow well 17 and 15 being a deeper well, the well configurations can take a variety of shapes in various embodiments. In fact, the posts 3 could be supported from a planar or other structure without wells 15,17 or with well and/or wells 15 or 17. By providing the posts 3 with the sockets 1 installed, the sockets 1 can be relatively easily turned to users to verify that the socket matches either an embossed identification 9, if provided, and/or so the socket 1 can be read for the user to decide whether or not to utilize while still securely holding the socket 1. Of course, in some embodiments, marking on exterior wall surfaces at the socket 1 could be at least partially obscured by wells 15 or 17.

First wells 17 are illustrated with a substantially similar first depth 91 which is shallower than a second depth 92 of second wells 15 in this preferred embodiment. Second depth 92 is illustrated wells 15,17 have well walls 93 which can assist in retaining a socket 1 by cooperating with an exterior surface 94 received at least partially therein substantially similar for the second well 15.

The preferred embodiment of the present invention provides a number of advantages. Specifically, many embodiments will hold the socket firmly by the socket groove illustrated as socket grooves 2 with posts 3. Other products are only known to utilize magnets along the sides of wells to hold sockets 1. However, the present invention allows for both holding socket 1 firmly, rotate freely when installed, the ability to be installed and uninstalled from the post 3 multiple times without a loss of grip function and to be manufactured as a one-piece design. A one piece design may be molded as a single piece with the posts 3 integral to the base(s) 90 and/or the device 100.

The trays 7 and/or 8 which are utilized may be permanently and/or temporarily connected can together be provided together or independently and/or in other arrangements. The device 100 may be placed into a box or storage container either vertically or horizontally. Other products available in the prior art are generally designed to be located vertically or horizontally, but not both.

It is another advantage of the preferred embodiment of the present invention to securely retain sockets 1 even when carried and maintained in an inverted conditions and/or vibration. Most other designs which are subjected to vibration or turning upside down release the socket.

Correct socket positioning when installing in the device 100 is also not always required for all embodiments whereas some prior art designs have a square perimeter pin (which does not grip an inserted socket or does not allow rotation of the inserted socket) but does require specific positioning of the socket relative to the pin to install.

Holder 100 has posts 3 which hold the sockets 1 by the socket groove 2 of the sockets 1. The device 100 provides a holding feature in the form of the bead 4 which can have a round circumference as illustrated in FIGS. 2A, 2B, 4, 6, 7, 8, 9 and 10. Holder device 100 and/or post 3 can be made of plastic or other material. Any material which can deflect the bead 4 when installed and uninstalled could be satisfactory.

The device 100 can work with various sets of socket drives and can be utilized with deep well sockets, shallow well sockets included but not limited to ¼ inch, 5/16 inch, ⅜ inch, 7/16 inch, ½ inch, 9/16 inch, ⅝ inch, 11/16 inch, ¾ inch, 13/16 inch, ⅞ inch and other sizes both in English units as well as metric units as well as some accessories such as bends, extension members, etc.

The preferred embodiment may provide a plastic injected holder 100 having injection molded plastic trays 7,8 to hold sockets and possibly tools such as extensions which could be in standard and/or metric sizes.

The wells such as 15,17 are preferably molded into trays 7,8 and have a bottom 31 from which the posts 3 upwardly extend therefrom in the illustrated embodiment. Other embodiments may have a bottom oriented perpendicularly to bottoms illustrated and posts 3 disposed at an angle and/or sideways. Other embodiments may be provided with or without wells 15,17 such as in trays, slide rails, or other structures in various configurations.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A socket holder holding at least one sockets comprising:

at least one socket having a shaft with at least one socket groove extending about at least a portion of the shaft radially beyond the shaft;

a plurality of posts extending from a base, each of said posts for connecting to respective sockets and having a round cross-section and at least one arm outwardly extending from the base and a radially disposed bead cantileveredly connected thereto, said bead contacting the shaft of a first socket of the at least one socket when placed thereon and then resiliently extending into the socket groove radially beyond the shaft with the bead extending into and cooperating with the socket groove, when in an installed configuration, with said post and bead allowing the first socket to rotate radially around said post with the bead retained in the socket groove regardless of the angular position of the socket relative to the post while resisting inadvertent removal of the first socket from the post and retaining the socket to the base when in the installed configuration, and said bead directed directly radially inwardly to the shaft out of the socket groove upon application of a sufficient force on the socket relatively away from the base thereby releasing the socket from the post, said post further comprising at least one slot vertically extending upwardly from the base.

2. The socket holder of claim 1 wherein the post extend from bottoms of wells, said wells having well walls which cooperate with and receive exterior walls of respective sockets when installed.

3. The socket holder of claim 2 wherein the wells further comprise a plurality of first wells having a substantially similar first depth.

4. The socket holder of claim 3 wherein the first wells are disposed substantially linearly.

5. The socket holder of claim 2 further comprising a plurality of second wells having a depth greater than the first depth.

6. The socket holder of claim 5 wherein the second wells have a substantially similar second depth.

7. The socket holder of claim 6 wherein the second wells are disposed substantially linearly.

8. The socket holder of claim 7 wherein the first wells are disposed substantially linearly.

9. The socket holder of claim 1 wherein the at least one arm with a bead connected thereto of the post further comprises at least two arms spaced apart by slots and at least a portion of the base is planar where the arms connect to the base and the socket provides a cross section when installed which is retained in the groove by the shaft until the sufficient force displaces the arms to release radial ends of the beads from the groove of the first socket.

10. The socket holder of claim 9 wherein the arms are symmetrically disposed about a center line.

11. The socket holder of claim 9 wherein the bead further comprises a beveled upper surface.

12. The socket holder of claim 11 wherein the bead further comprises a beveled bottom surface.

13. The socket holder of claim 12 wherein the arm has an upper portion and the upper portion has a diameter smaller than an internal perimeter effective diameter of the square shaft of the first socket prior to the first socket being installed on the post.

14. The socket holder of claim 13 wherein the arms have a body and a diameter taken around the body, is smaller than the internal effective diameter of the shaft of the first socket prior to first socket being installed on the post.

15. The socket holder of claim 13 wherein the shoulder of the arm is beveled.

16. A socket holder for holding at least one sockets comprising:

at least one socket having a shaft with at least one groove extending radially therefrom beyond a perimeter of the shaft, said holder comprising:

a plurality of posts connected to a base, said posts having a round cross-section, each having at least two or more arms outwardly extending from the base, with adjacent arms separated at least partially by slots and further comprising at least one a bead cantileveredly connected to each of the at least two arms, said beads contacting the shaft of a first socket of the at least one socket when placed thereon and then resiliently extending into the socket groove radially beyond the shaft groove regardless of the angular position of the socket relative to the post to retain the first sockets in an inserted configuration on the post, and said post having cross sectional shape extending radially around a perimeter of the post facilitating the socket being able to rotate radially around said post in the installed configuration.

17. The socket holder of claim 16 wherein the posts extend from bottoms of wells, said wells having well walls which cooperate with and receive exterior walls of the first socket or sockets when installed.

18. The socket holder of claim 16 wherein the arms are symmetrically disposed about a center line.

19. The socket holder of claim 16 wherein the bead further comprises a beveled upper surface.

20. The socket holder of claim 16 wherein said bead is directed directly radially inwardly to the shaft out of the socket groove upon application of a sufficient force on the first socket relatively away from the base thereby releasing the bead from the socket groove facilitating the first socket to then be disengaged from the post.

* * * * *